US011731802B2

(12) United States Patent
Trasacco

(10) Patent No.: US 11,731,802 B2
(45) Date of Patent: Aug. 22, 2023

(54) PLATE POCKET FOR PIZZA BOX

(71) Applicant: Barry Trasacco, West Haven, CT (US)

(72) Inventor: Barry Trasacco, West Haven, CT (US)

( * ) Notice: Subject to any disclaimer, the term of this patent is extended or adjusted under 35 U.S.C. 154(b) by 192 days.

(21) Appl. No.: 16/930,806

(22) Filed: Jul. 16, 2020

(65) Prior Publication Data

US 2021/0323721 A1 Oct. 21, 2021

Related U.S. Application Data

(60) Provisional application No. 62/875,637, filed on Jul. 18, 2019.

(51) Int. Cl.

| | |
|---|---|
| ***B65D 5/48*** | (2006.01) |
| ***B65D 85/36*** | (2006.01) |
| ***B65D 5/18*** | (2006.01) |
| ***B65B 5/02*** | (2006.01) |
| ***B65B 69/00*** | (2006.01) |
| ***B65D 5/50*** | (2006.01) |

(52) U.S. Cl.

CPC ..... *B65D 5/48002* (2013.01); *B65B 5/024* (2013.01); *B65B 69/00* (2013.01); *B65D 5/18* (2013.01); *B65D 5/5028* (2013.01); *B65D 85/36* (2013.01); *B65D 2585/366* (2013.01)

(58) Field of Classification Search

CPC ..... B65D 2585/366; B65D 85/36; B65D 5/5028; B65D 5/18; B65D 5/48002; B65D 5/48024; B65D 5/4233; B65D 81/3853; B65D 5/66; B65D 5/50; A47G 23/0608; A47G 21/00; A47J 47/14

USPC ..... 229/903, 902, 906, 103, 120.32; 206/549, 551, 562, 223

See application file for complete search history.

(56) References Cited

U.S. PATENT DOCUMENTS

| | | | | |
|---|---|---|---|---|
| 4,572,423 | A * | 2/1986 | Spencer | B65D 5/0015 206/509 |
| 4,819,862 | A | 4/1989 | Maroszek | |
| 4,836,383 | A | 6/1989 | Gordon et al. | |
| 5,110,038 | A | 5/1992 | Pantisano et al. | |
| 5,509,601 | A | 4/1996 | Drabick | |
| 5,542,540 | A | 8/1996 | Knapp et al. | |

(Continued)

FOREIGN PATENT DOCUMENTS

| | | | | |
|---|---|---|---|---|
| CN | 107835772 | A * | 3/2018 | A41D 13/04 |
| FR | 2726812 | A1 * | 5/1996 | B65D 25/205 |

(Continued)

*Primary Examiner* — Christopher R Demeree

(74) *Attorney, Agent, or Firm* — DeLio Peterson & Curcio LLC; Brian G Schlosser

(57) ABSTRACT

A unique pizza box apparatus and methods of forming and using said pizza box are disclosed. The pizza box is formed with an additional plate pocket for receiving plates therein. The pocket is connected to an inside surface of the pizza box lid and expands a distance less than that of the depth of the pizza box. On the pizza box lid is a cut or perforated plate pocket lid with a living hinge on one end and a lid tab on a substantially opposite end for grabbing and rotatably opening the plate pocket lid with respect to the pizza box lid. A pizza bumper may further be included within the box to ensure separation between a base of the plate pocket and a pizza once the pizza is placed within the box. Napkins and/or further utensils may also be placed within the plate pocket if so desired.

20 Claims, 11 Drawing Sheets

(56) References Cited

U.S. PATENT DOCUMENTS

| | | | | |
|---|---|---|---|---|
| 6,386,440 | B1 | 5/2002 | Tulkoff | |
| 6,755,711 | B2 | 6/2004 | McClung et al. | |
| 6,899,587 | B2 | 5/2005 | McClung et al. | |
| 6,905,065 | B2 * | 6/2005 | Holden | B65D 5/4295 229/906 |
| 7,222,773 | B2 | 5/2007 | Smith et al. | |
| 8,770,466 | B1 | 7/2014 | Terlesky et al. | |
| 10,166,451 | B1 * | 1/2019 | Laskowitz | A63B 67/06 |
| 11,066,207 | B2 * | 7/2021 | Cavaceppi | B65D 5/5028 |
| 2003/0029769 | A1 * | 2/2003 | Ausaf | B65D 81/113 206/541 |
| 2006/0226206 | A1 | 10/2006 | Reap | |
| 2011/0186621 | A1 | 8/2011 | Parker | |

FOREIGN PATENT DOCUMENTS

| | | | | |
|---|---|---|---|---|
| WO | WO-2011070563 | A1 * | 6/2011 | B65D 85/36 |
| WO | 2015123709 | A1 | 8/2015 | |
| WO | WO-2019030663 | A1 * | 2/2019 | B65D 5/4237 |

* cited by examiner

PLATE POCKET FOR PIZZA BOX

BACKGROUND OF THE INVENTION

1. Field Of The Invention

The present invention relates to a system, apparatus and method for packaging and delivering serving plates along with a pizza in the same size as an otherwise standard pizza box.

2. Description of Related Art

Customers who order take-out pizza or pizza for delivery eventually need to have serving plates on which to serve the pizza slices. Currently such serving plates are either not supplied with the take-out or delivered pizza at all, or are packaged separately, in a manner which is often awkward and difficult to handle with the pizza box.

U.S. Patent Application No. 2011/0186621 published to Parker and titled "PIZZA BOX WITH STORAGE COMPARTMENTS" discloses a pizza box with full width storage compartments located on the top and bottom lids of the box for holding paper plates/collapsible cups. These compartments are accessible by removing separate cardboard inserts that are sealed by a peel-off adhesive ring disposed on the top and bottom lids. This requires adhesively binding the inserts to the lids and providing completely separate compartments within the pizza box itself.

It would be advantageous to provide an improved packaging procedure to make the process of accessing the plates easier for end users (e.g. people receiving the delivery/takeout order) and provide a more environmentally friendly solution that does not waste excess cardboard in forming the pizza box.

SUMMARY OF THE INVENTION

Bearing in mind the problems and deficiencies of the prior art, it is therefore an object of the present invention to provide an improved system, apparatus and method for packaging and delivering serving plates along with a pizza in the same size as an otherwise standard pizza box.

It is another object of the present invention to provide a pizza box with a plate pocket formed within the box and having a pocket lid that is formed without necessitating excess cardboard.

Yet another object of the present invention is to provide an improved method for using a pizza box to store pizza, plates and/or napkins and utensils therein.

Still another object of the present invention is to provide an improved method for making a pizza box for storing plates along with a pizza therein.

The above and other objects, which will be apparent to those skilled in the art, are achieved in the present invention which is directed to a pizza box, comprising a base having sidewalls extending perpendicular from its edges, and a lid having a top surface and a bottom surface connected to one of said sidewalls, such that the lid may swing from an open position exposing the inside of the box to a closed position resting adjacent to the sidewalls. A plate pocket extends downwards from the bottom surface of the box lid a distance that is less than the total depth of the box. This plate pocket is sized to receive at least one plate therein. A plate pocket lid is formed from the box lid top surface via a cut or perforations cut into the box lid. A portion of the plate pocket lid is not cut or perforated to act as a living hinge that allows for the plate pocket lid to swing between an open position exposing the inside of the plate pocket to a closed position resting flush with the box lid top surface.

In an embodiment, the pizza box includes a separator disposed within the pizza box to support the pocket when the lid is in the closed position. The plate pocket lid may have dimensions comparable to the plate pocket. A lid tab may be disposed on an end of the plate pocket lid opposite of the living hinge to allow for an easier grip and control of the plate pocket lid when swinging the plate pocket lid about its living hinge. The plate pocket may be formed in a substantially ellipse shape. The plate pocket lid may also be formed in a substantially ellipse shape. Alternatively, the plate pocket may be formed to substantially cover an inside surface of the box lid, such that connecting flaps of the plate pocket adhere to the bottom surface of the box lid, or to foldable flaps or flanges that extend downwardly from a perimeter of the box lid. The plate pocket lid may be formed into a parallelogram shape.

The present invention is further directed to a method of making a pizza box for storing plates alongside a pizza therein. The method provides a pizza box having a base with a top surface and sidewalls extending perpendicular from its edges, and a lid having a top surface and a bottom surface connected to one of said sidewalls, such that the lid may swing from an open position exposing the inside of the box to a closed position resting adjacent to the sidewalls. The method includes the steps of: attaching a plate pocket to the bottom surface of the box lid such that the plate pocket extends downward from the box lid a distance less than the total depth of the pizza box; and cutting a plate pocket lid such that the pocket lid is substantially aligned with the plate pocket, and a portion of the pocket lid is left uncut to act as a living hinge to allow for the pocket lid to rotatably open and close about the box top surface.

In an embodiment, the method further includes the step of cutting a pocket lid tab on an end of the plate pocket lid substantially opposite the pocket lid living hinge. The plate pocket lid may be cut into a substantially ellipse shape. The plate pocket lid may alternatively be cut into a parallelogram shape. The step of cutting the plate pocket lid may further be defined by cutting perforations into the box lid in the shape of the plate pocket lid. The method may further include the step of disposing a separator within the pizza box to suspend a base of the plate pocket above the top surface of the pizza box base.

The present invention is also directed to a method of using a pizza box to store plates and a pizza therein. The method provides a pizza box with a base having sidewalls extending perpendicular from its edges, and a lid having a top surface and a bottom surface connected to one of said sidewalls, such that the lid may swing from an open position exposing the inside of the box to a closed position resting adjacent to the sidewalls; a plate pocket connected to and extending downwards from the box lid a distance less than the total depth of the box, the plate pocket being sized for receiving at least one plate therein; and a plate pocket lid formable from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface. The method includes the steps of: opening the pizza box lid to expose the plate pocket, and inserting a plate into the plate pocket, placing a pizza within the pizza box base such that the pizza is surrounded by the base sidewalls.

In an embodiment, the method further includes placing a plurality of plates into the plate pocket. The method may further include placing utensils and/or napkins within the plate pocket. The step of inserting the plate into the plate pocket may be achieved by sliding the plate into a gap disposed between the bottom surface of the pizza box lid and a base of the plate pocket. The plate pocket lid may be cut into the pizza box lid, and the step of inserting the plate into the plate pocket may be achieved by opening the plate pocket lid to expose the plate pocket, and inserting the plate into said exposed plate pocket. The method may further include the step of placing a separator on top of the pizza after the pizza is placed within the pizza box, such that the bumper contacts a base of the plate pocket to create a gap between the plate pocket and the pizza to prevent contact between said plate pocket and said pizza.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-11 of the drawings in which like numerals refer to like features of the invention.

The embodiment(s) shown of the system, apparatus and method for packaging and delivering serving plates along with a pizza is constructed of similar cardboard, plastic and otherwise disposable materials in the same dimensions as an otherwise standard pizza box, sized to fit the size of the pizza being delivered. A standard pizza box base is shown throughout each embodiment, but instead of having a normally plain lid, the lid of the pizza box embodiments of the present invention have built-in a pocket for holding the serving plates for the pizza slices. Because serving plates are normally circular, the pocket shown is also circular as seen in a first embodiment in FIGS. 1-7, although other shapes and configurations may be employed to match the serving plates or other contents of the pocket as shown in an alternate embodiment in FIGS. 8-11. The width or diameter of the plate pocket is sufficient to accommodate the plate size. In addition to serving plates, napkins and utensils such as forks, knives and spoons may also be provided in the plate pocket.

Figure 5:
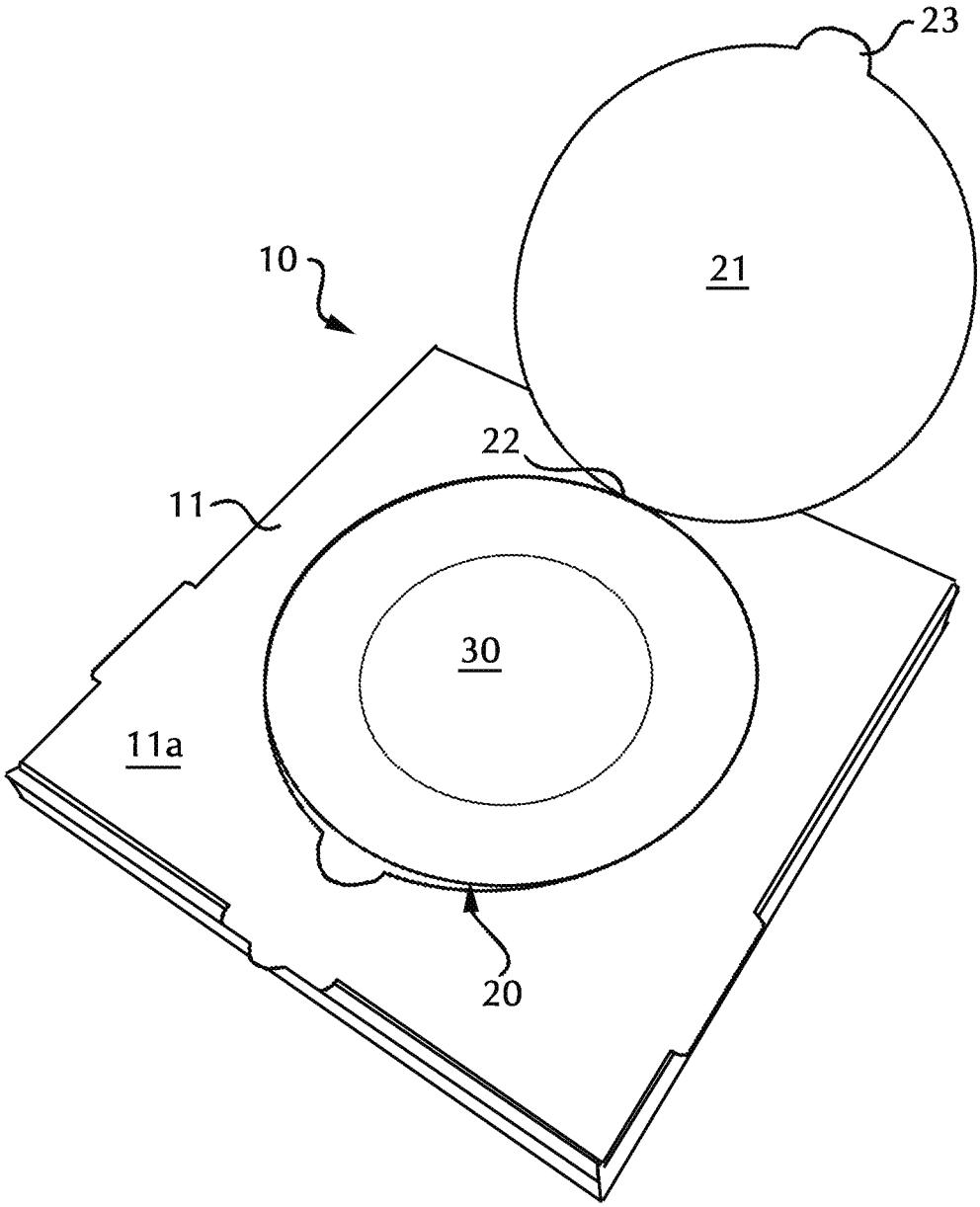
FIG. 5 is a perspective view of the pizza box and plate pocket of FIG. 4, with the lid of the plate pocket in the open position and showing plates disposed within the plate pocket.
Figure 6:
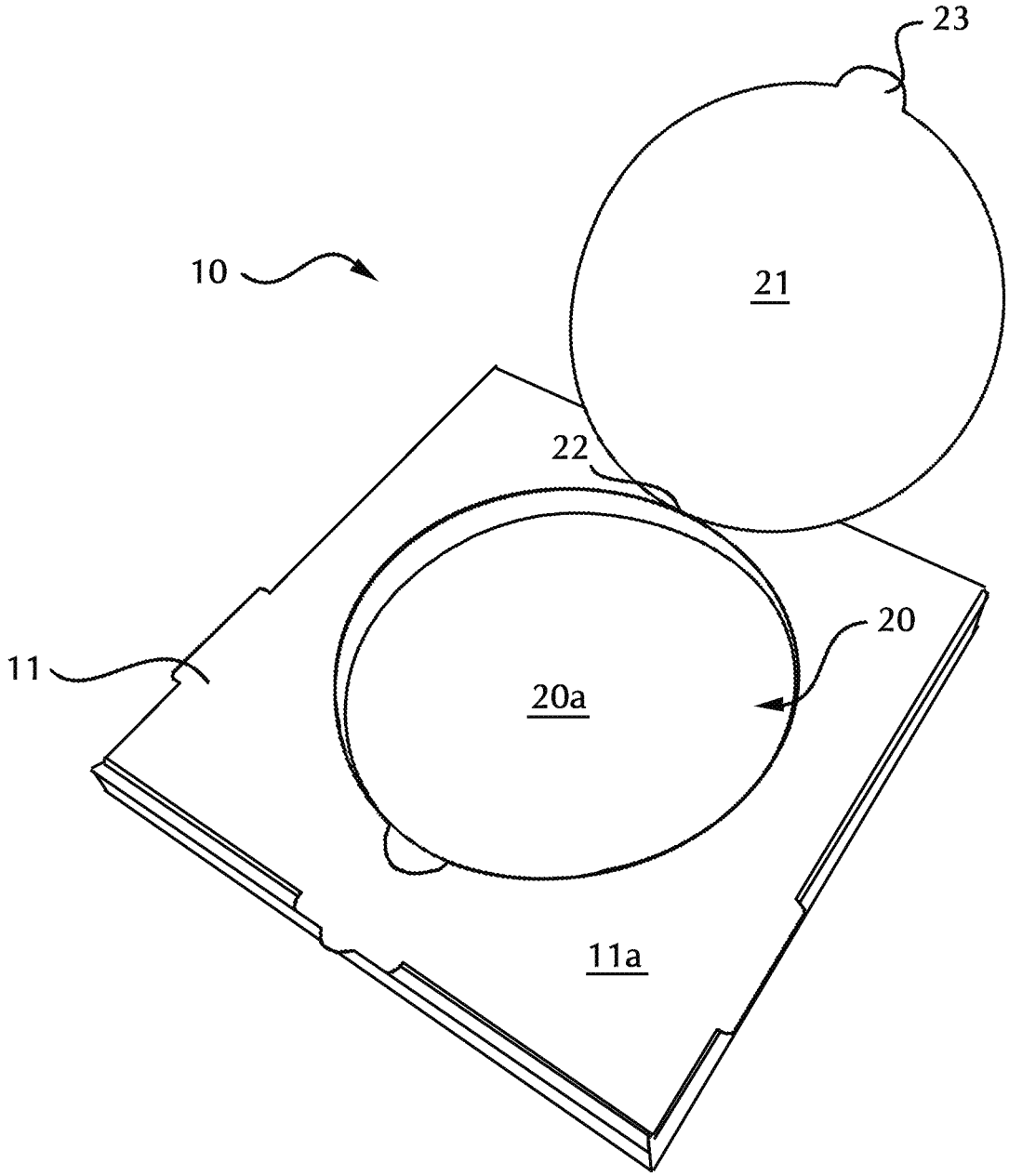
FIG. 6 is a perspective view of the pizza box and plate pocket of FIG. 4, with the lid of the empty plate pocket in the open position.
Figure 7:
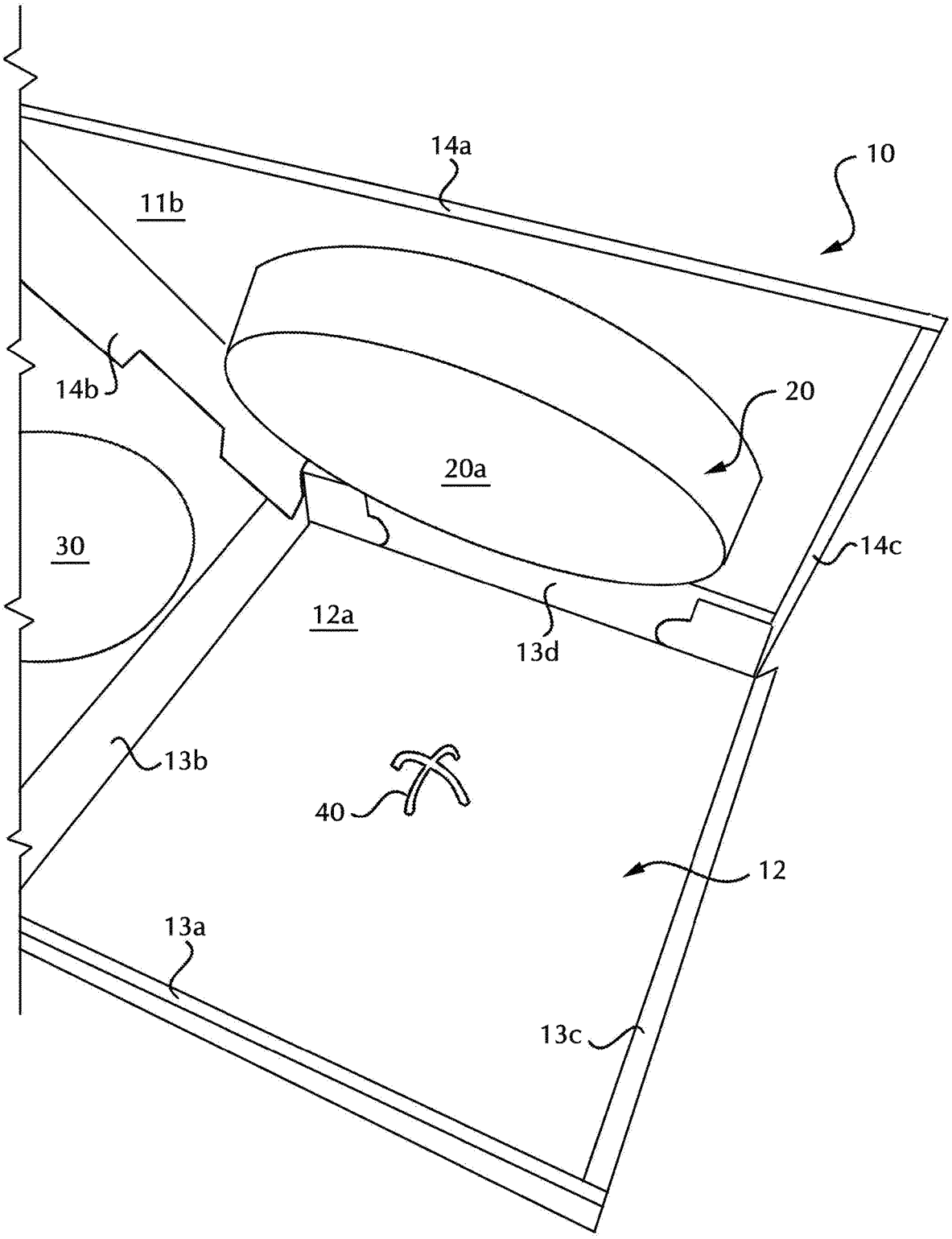
FIG. 7 is a perspective view of the pizza box and plate pocket of FIG. 4, with the lid of the pizza box in the open position.
Figure 8:
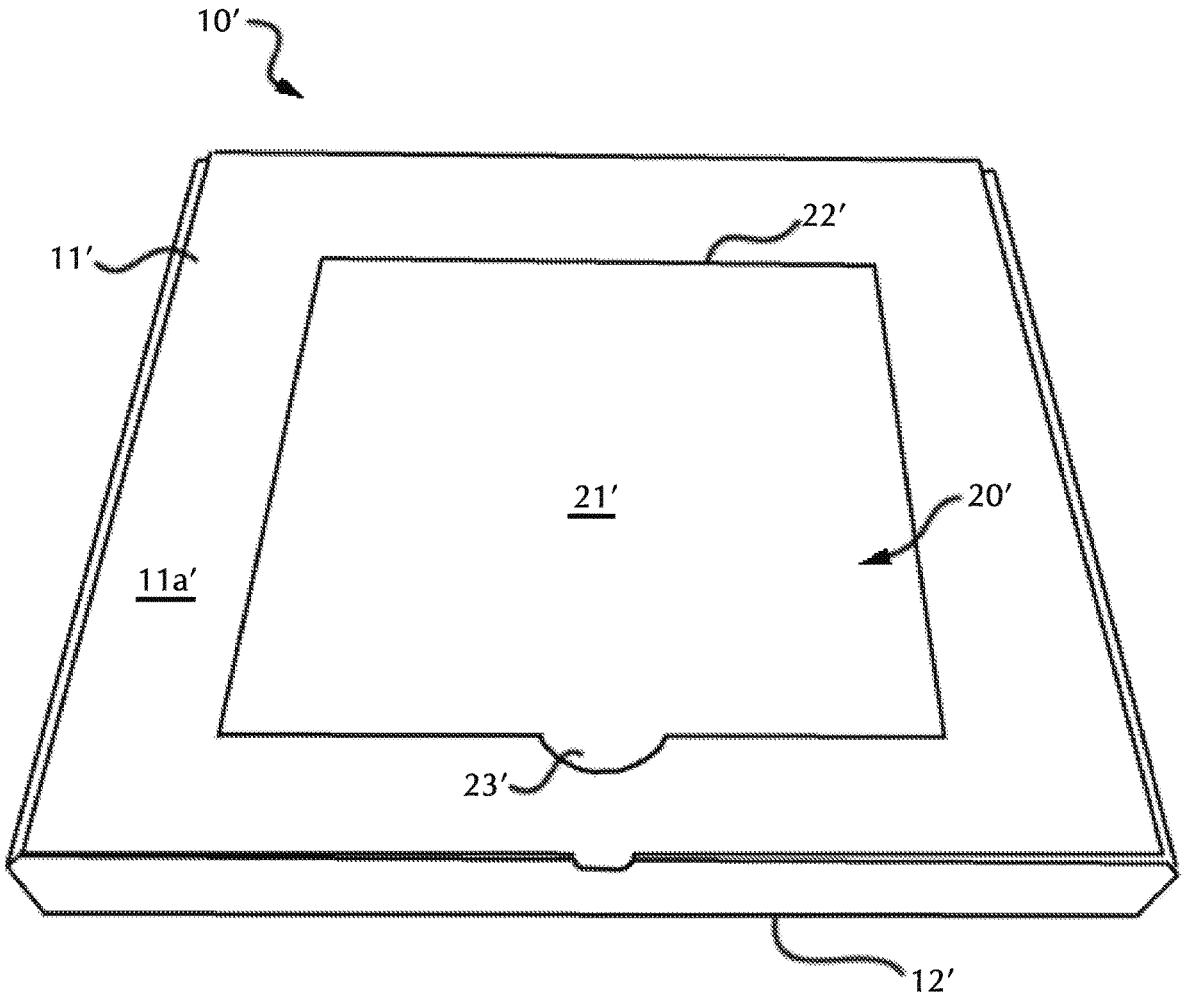
FIG. 8 is a front perspective view of an embodiment of the pizza box and plate pocket of the present invention, with the box lid and pocket lid in the closed positions.
Figure 9:
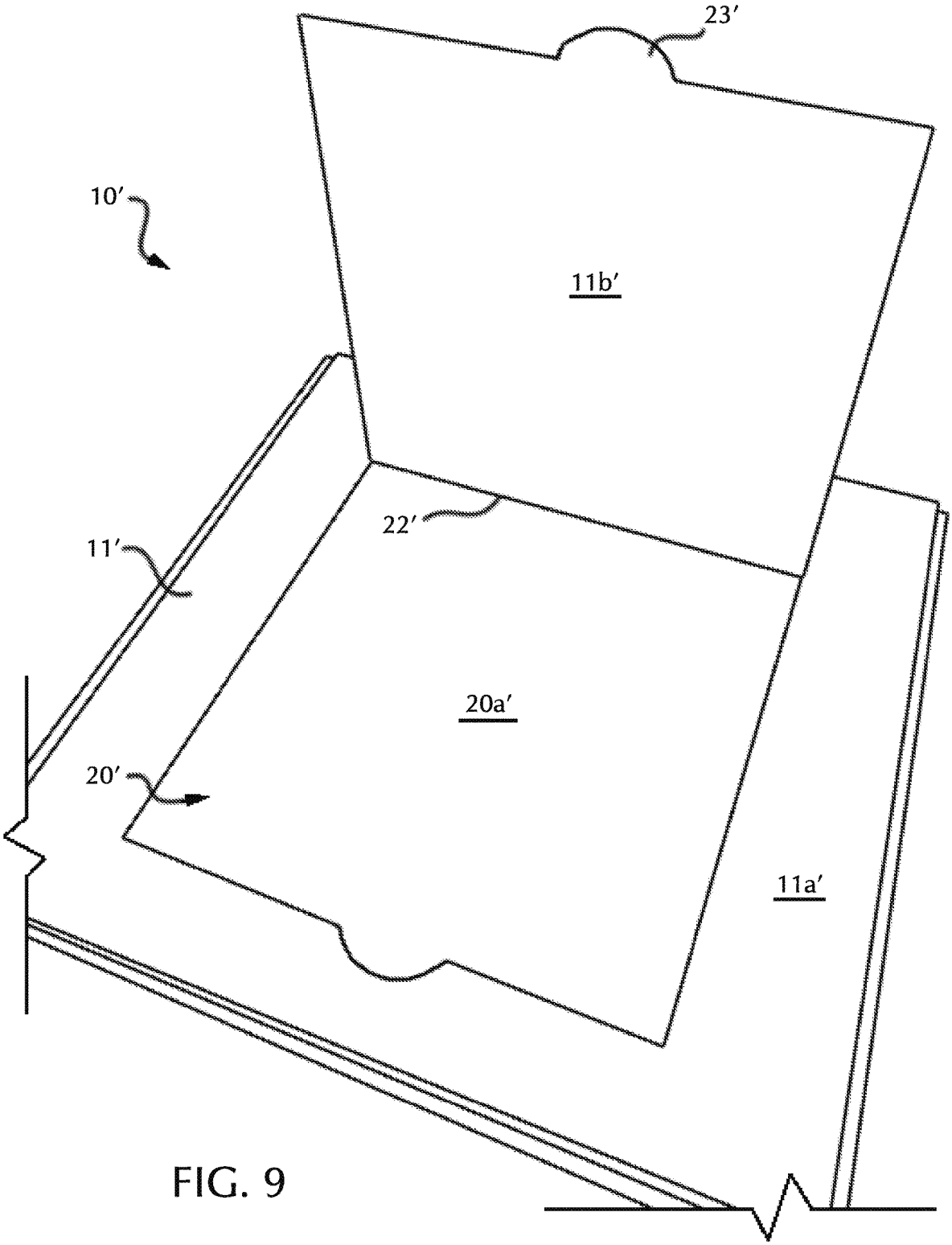
FIG. 9 is a front perspective view of the pizza box and pocket of FIG. 8, with the lid of the empty plate pocket in the open position.

A first embodiment of a pizza box 10 as shown in FIGS. 1-7 has a box lid 11 with a top surface 11*a* and a bottom surface 11*b* facing the inside of the box 10, and a base 12 having a top surface 12*a* facing the inside of the box 10. Box lid 11 includes foldable flaps or flanges 14*a*, 14*b*, 14*c* that extend from the perimeter or edge of the lid 11 and can be folded to extend downwardly from the lid edges. Base 12 includes sidewalls 13*a*, 13*b*, 13*c*, 13*d* extending perpendicular from its edges, with the box lid 11 being connected to sidewall 13*d* as shown in FIG. 7. Foldable flaps or flanges 14*a*, 14*b*, 14*c* of lid 11 nest into and between sidewalls 13*a*, 13*b* and 13*c*. A plate pocket 20 extends downward from the box lid 11 a distance less than the total depth of the pizza box (i.e. from lid bottom surface 11*b* to base top surface 12*a*), so that there is room below a plate pocket bottom or base 20*a* for a pizza 50. Additionally, the diameter of the plate pocket 20 is less than the width dimensions of the interior of the pizza box 10. The pizza 50 will be able to be disposed between the plate pocket base 20*a* and the box base top surface 12*a*.

Figure 4:
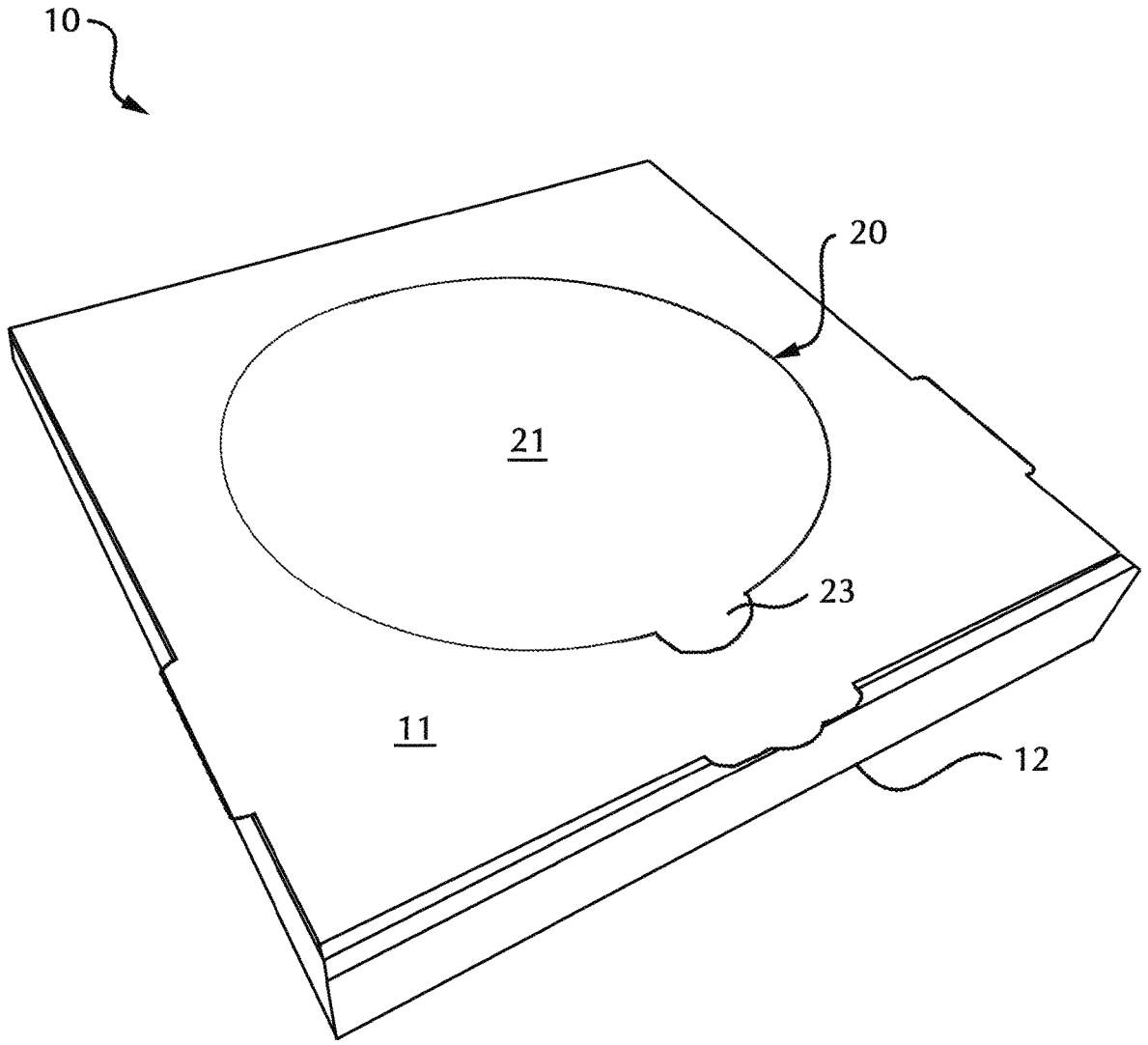
FIG. 4 is a perspective view of an embodiment of the pizza box and plate pocket of the present invention, with the box lid and pocket lid in the closed positions.

A plate pocket lid 21 sits flush with the box top surface 11*a* and is cut or perforated into a substantially ellipse shape, such as that of a circle, or other curved configuration as seen in FIGS. 4-6. At an end of the pocket lid 21 is a lid tab 23 protruding from the pocket lid 21 to provide an end user with an easier grip to open the lid 21. A lid hinge 22 is disposed substantially diametrically opposite from the lid tab 23, and allows the plate pocket lid 21 to be rotatably opened separately from the pizza box lid 11 to provide access to plates 30—or any other utensils/napkins—that may be disposed within the pocket 20.

Figure 1:
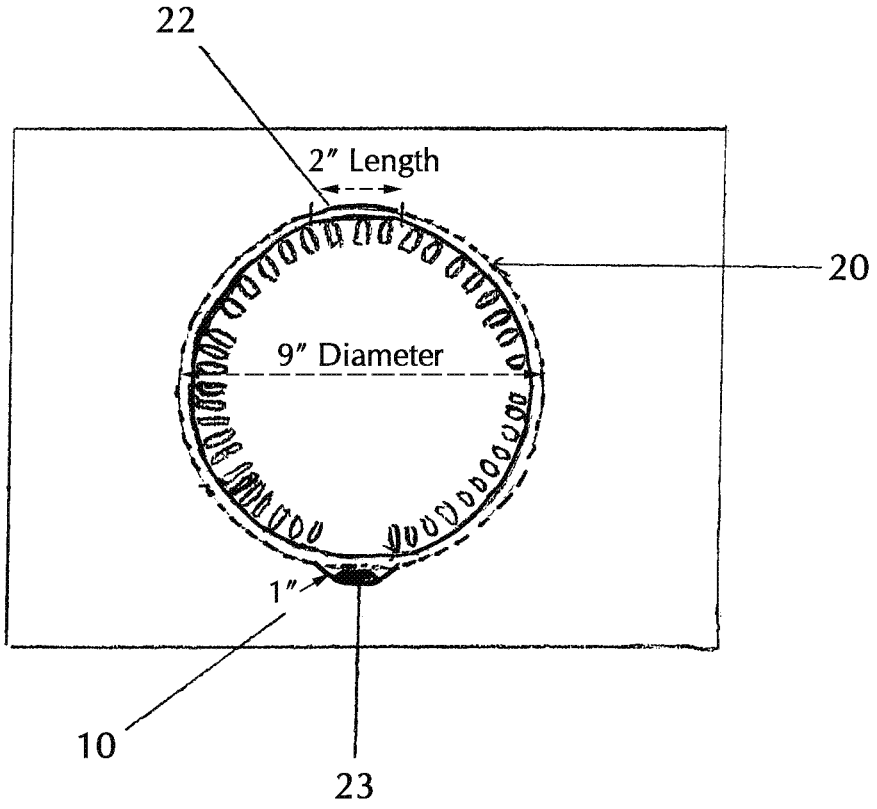
FIG. 1 is a top plan view of an embodiment of the pizza box having the plate holder or pocket in the closed lid of the pizza box, with the cover of the plate pocket in phantom view to show the serving plates stored in the plate pocket.

The plate pocket 20 extends downward from the pizza box lid a distance less than the total depth of the pizza box 10, so that there is room below the plate pocket bottom or base 20*a* for the pizza 50. The depth of the plate pocket will determine the number of plates 30 that may be stacked and secured, and may be about 1 inch in depth, for a typical pizza box depth of 2 inches. The diameter of the plate pocket may be, in the instance of a circular plate pocket as shown in FIG. 1, 9 inches for a standard paper plate, comparable to the diameter of the plate pocket lid. The plate pocket lid 21 is hinged so that the lid 21 may be opened separately from the pizza box lid 11 to access the plates 30. The plate pocket lid 21 may be stamped, cut, or perforated into the pizza box lid 11, except for the lid hinge 22, so that the lid material (typically cardboard) serves as a living hinge. The lid tab 23 may be cut into the plate pocket lid 21 substantially opposite the lid hinge 22 so that a user can grasp it to open the pocket lid 21. The sides and bottom that make up the plate pocket body may be made of any suitable material, such as cardboard or plastic, and secured to the bottom surface 11*b* of the pizza box lid 11 below the plate pocket lid 21, for example, by adhesive or adhesive tape. The plate pocket body extends at its side edges to the bottom surface 11*b* of the pizza box lid 11. The paper, plastic or otherwise disposable serving plates 30 may be loaded into the plate pocket 20 before the plate pocket 20 is secured to the bottom surface 11*b* of the pizza box lid 11. Alternatively, the plates 30 may be loaded into the plate pocket 20 by opening the pocket lid 21 and inserting the plates through the opening in the pizza box lid 11*a*.

Figure 10:
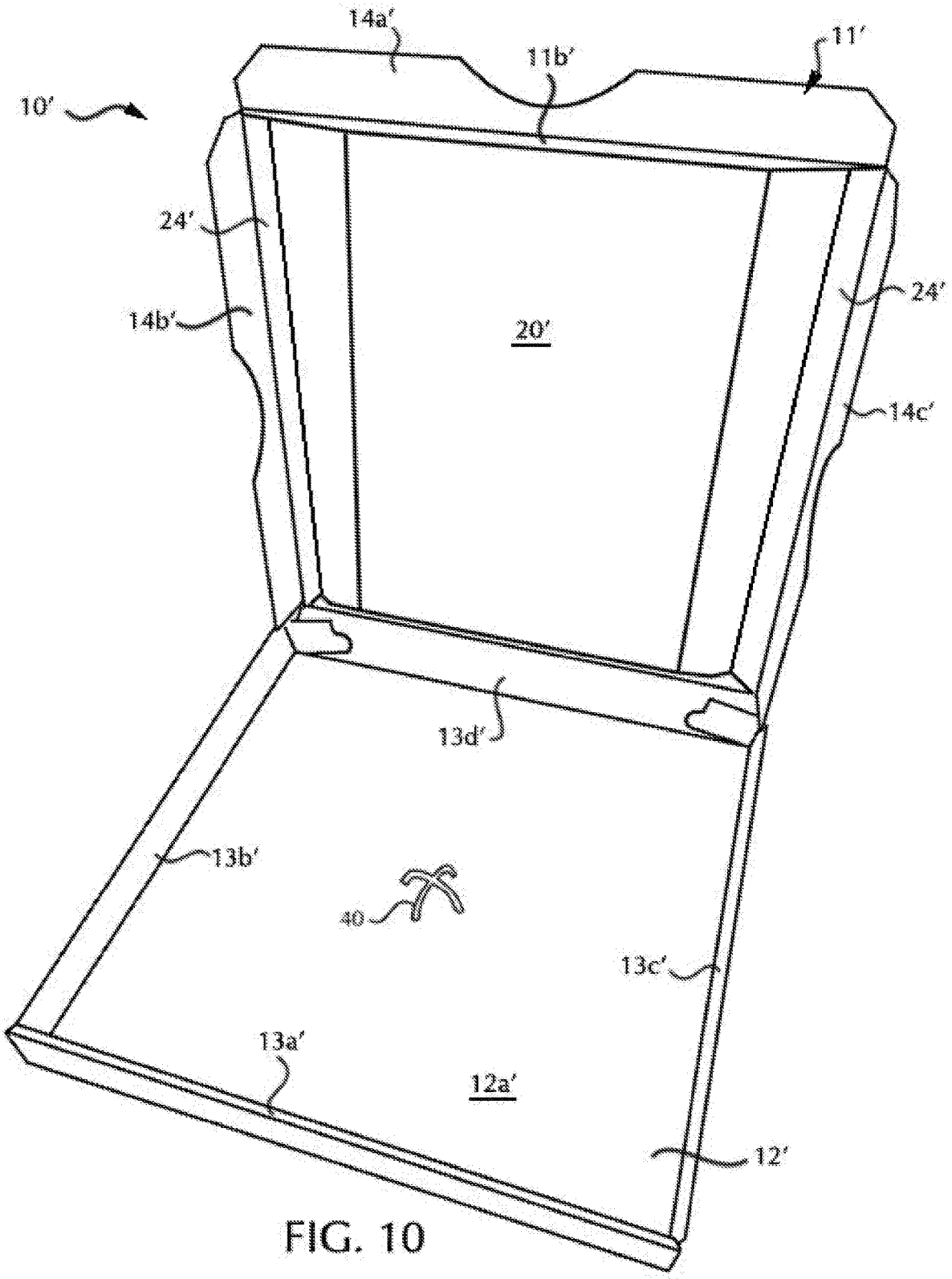
FIG. 10 is a front perspective view of the pizza box and pocket of FIG. 8, with the lid of the pizza box in the open position.

A second embodiment of the pizza box 10' shown in FIGS. 8-11 has a box lid 11' with a top surface 11*a*' and a bottom surface 11*b*' facing the inside of the box 10', and a base 12' with a top surface 12*a*' facing the inside of the box 10'. Box lid 11' includes foldable flaps or flanges 14*a*', 14*b*', 14*c*' that extend from the perimeter or edge of the lid 11' and can be folded to extend downwardly from the lid edges. Base 12' includes sidewalls 13*a*', 13*b*', 13*c*', 13*d*' extending perpendicular from its edges, with the box lid 11' being connected to sidewall 13*d*' as shown in FIG. 10. Foldable flaps or flanges 14*a*', 14*b*', 14*c*' of lid 11' nest into and between sidewalls 13*a*', 13*b*' and 13*c*'. A plate pocket 20' extends downward from the lid 11*a*' a distance less than the total depth of the pizza box (i.e. from lid bottom surface 11*b*' to base top surface 12*a*'), so there is room below a plate pocket bottom or base 20*a*' for the pizza. The edges of the plate pocket 20' extend to the bottom surface 11*b*' of the pizza box lid 11, and connecting flaps 24' may be provided at the plate pocket edges to adhere the plate pocket to either bottom surface 11*b*' (stopping at the flaps or flanges 14*b*', 14*c*'), or to the downwardly extending flaps or flanges 14*b*', 14*c*' of lid 11' as shown in FIG. 10. The pizza 50 will be able to be disposed between the plate pocket base 20*a*' and the box base top surface 12*a'*.

A plate pocket lid 21' sits flush with the box top surface 11*a*' and is cut, stamped, or perforated into a parallelogram. At an end of the pocket lid 21' is a lid tab 23' protruding from the pocket lid 21' to provide an end user with an easier grip to open the lid 21'. A lid hinge 22' is disposed substantially opposite from the lid tab 23', and allows the plate pocket lid 21' to be rotatably opened separately from the pizza box lid 11' to provide access to the plates 30—or any other utensils/napkins—that may be disposed within the pocket 20'.

Figure 11:
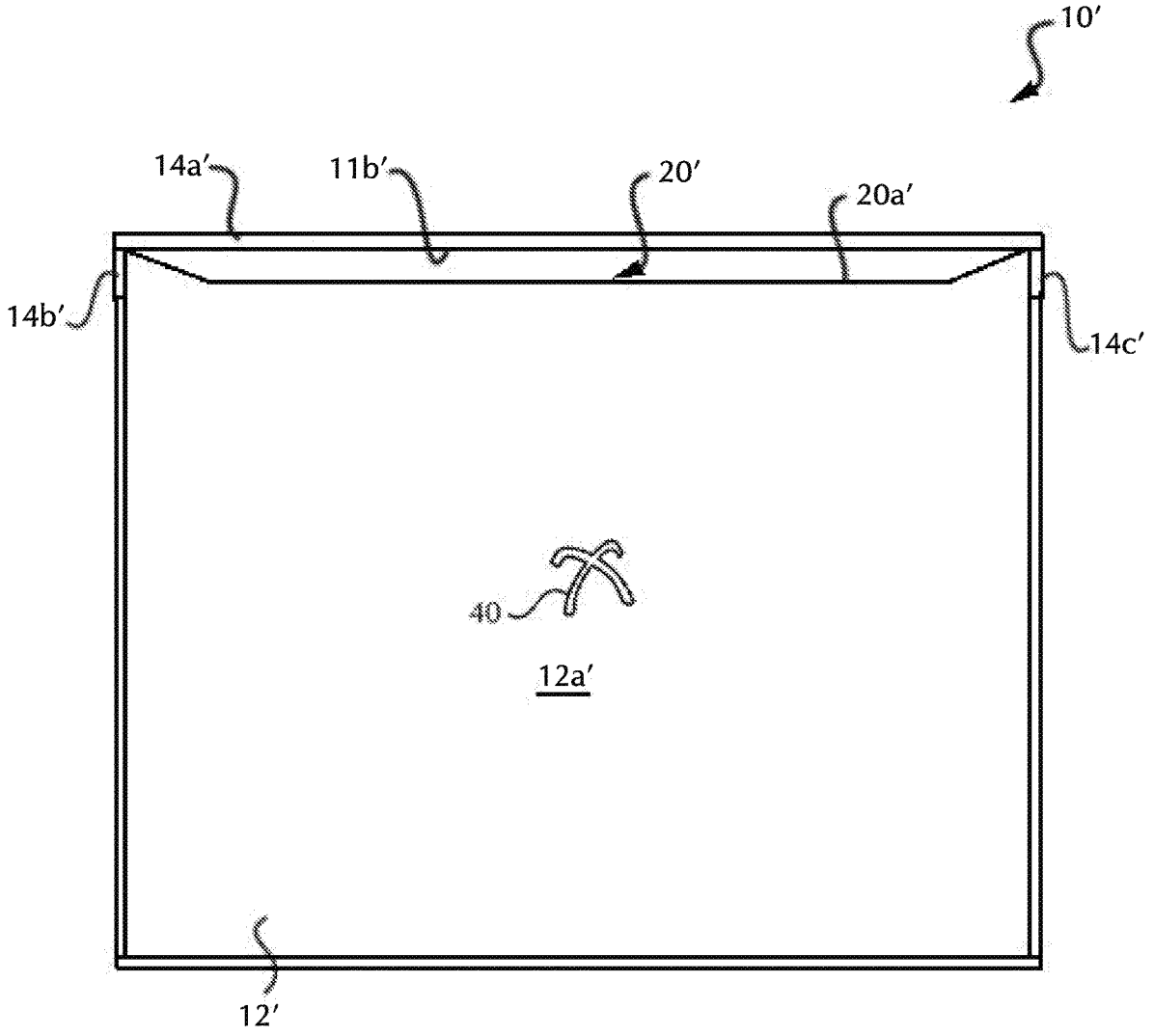
FIG. 11 is a top-down view of the pizza box and pocket of FIG. 8, with the lid of the pizza box open at a 90° angle such that the view is looking directly down into the opening of the plate pocket.

The plate pocket base 20*a*' may expand to cover substantially the entirety of the box lid bottom surface 11*b*', as shown in FIG. 10. Plates 30 may be inserted into the pocket 20' either by opening the pocket lid 21' and inserting the plates through the opening created in the box lid 11', or by opening the box lid 11' and inserting the plates into the pocket 21' through the gap between the box lid bottom surface 11*b*' and pocket plate base 20*a*', as shown in FIG. 11.

The dimensions of the plate pocket lid 21' may be, for example, a 12 in. by 12 in. square, with the pocket lid tab 23' extending at about a ¾ in. length and about a 2 in. width from an edge of the pocket lid 21'. These dimensions are presented merely as examples and should not be interpreted as limiting the present invention as described herein. Other dimensions of the plate pocket 20' and pocket lid 21' may be used to accommodate plates 30 of varying dimensions and/or quantities, and any other utensils/napkins that may be desirable to insert into the pocket 20'.

Figure 2:
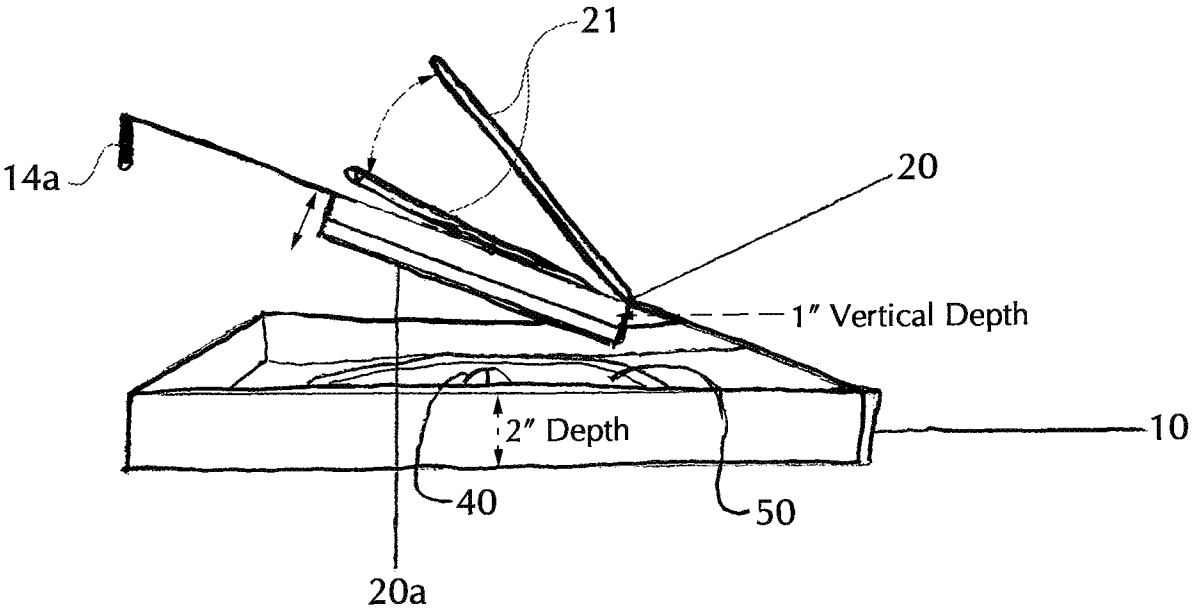
FIG. 2 is a side view, partially in perspective, of the pizza box of FIG. 1 with the pizza box lid partially open, and a side elevational view of the plate pocket extending downward from the pizza box lid, and the plate pocket cover in various stages of opening.
Figure 3:
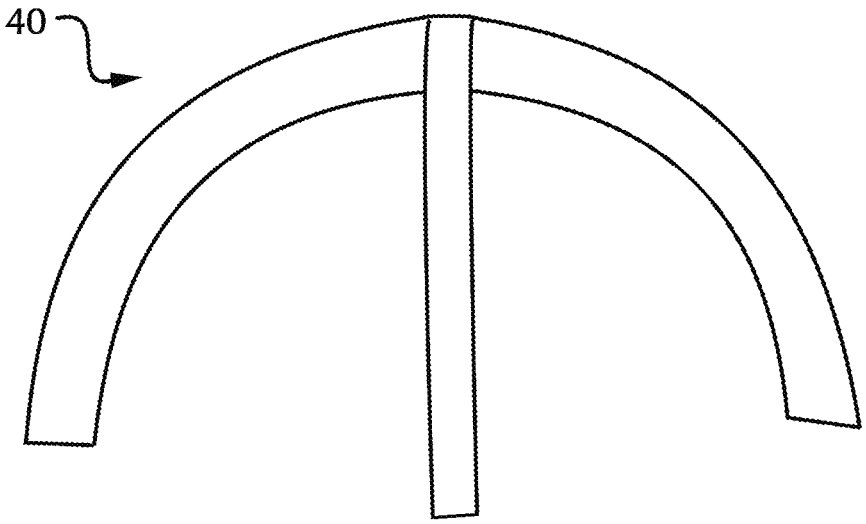
FIG. 3 is a front perspective view of the pizza separator or bumper shown in FIG. 2.

To keep proper separation of the pizza from the base 20*a*, 20*a*' of the plate pocket 20, 20', a pizza separator or bumper 40 is employed. In the embodiment shown in FIG. 3, the pizza separator or bumper 40 has four curved legs extending outwardly in a cross-pattern and down from an upper connection point. In side view the legs have a downward concave configuration. The bumper 40 is placed in the pizza box after the pizza is inserted into the box 10, 10', such that the bumper 40 legs rest on top of the pizza, and the upper point contacts and supports the plate pocket base 20*a*, 20*a*'. The total height of the pizza separator or bumper is the difference between the depth of the plate pocket 20, 20' and the height of the pizza box 10, 10', which may be about 1 inch as shown in FIG. 2. The legs may be made of plastic, for example, having a thickness of about ⅛ inch. The pizza box of the present invention may be made with the pizza box lid 11, 11' integral with the pizza box base 12, 12', and using the same folded side templates employed in otherwise conventional pizza boxes, and may be shipped to the restaurant unfolded for assembly when needed, in the manner now typically used.

Thus, the present invention provides an improved system, apparatus and method for packaging and delivering serving plates along with a pizza in the same size as an otherwise standard pizza box.

While the present invention has been particularly described, in conjunction with one or more specific embodiments, it is evident that many alternatives, modifications and variations will be apparent to those skilled in the art in light of the foregoing description. It is therefore contemplated that claims to the invention will embrace any such alternatives, modifications and variations as falling within the true scope and spirit of the present invention.

Thus, having described the invention, what is claimed is:

1. A pizza box comprising:

a base having sidewalls extending perpendicular from edges of said base, and a lid having a top surface and a bottom surface connected to one of said sidewalls, such that the lid may swing from an open position exposing an inside of the box to a closed position resting adjacent to the sidewalls;

a plate pocket comprising a base and sidewalls extending downwards from the bottom surface of the box lid a distance less than the total depth of the box, the plate pocket sized to receive at least one plate therein; and a plate pocket lid formed from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface.

2. The pizza box of claim 1 further including a separator disposed within the pizza box to support the pocket when the lid is in the closed position.

3. The pizza box of claim 1 wherein the plate pocket lid has dimensions comparable to the plate pocket.

4. The pizza box of claim 1 further including a lid tab disposed on an end of the plate pocket lid opposite the living hinge to allow for easier grip and control of the plate pocket lid when swinging the plate pocket lid about its living hinge.

5. The pizza box of claim 1 wherein the plate pocket is formed to substantially cover an inside surface of the box lid, such that connecting flaps of the plate pocket adhere to the bottom surface of the box lid, or to foldable flaps or flanges that extend downwardly from a perimeter of the box lid.

6. The pizza box of claim 5 wherein the plate pocket lid is formed into a parallelogram shape.

7. A pizza box comprising:

a base having sidewalls extending perpendicular from edges of said base, and a lid having a top surface and a bottom surface connected to one of said sidewalls, such that the lid may swing from an open position exposing an inside of the box to a closed position resting adjacent to the sidewalls;

a plate pocket extending downwards from the bottom surface of the box lid a distance less than the total depth of the box, the plate pocket sized to receive at least one plate therein; and a plate pocket lid formed from the box lid top surface via a cut or perforations cut into the box lid, wherein the plate pocket is formed in a substantially ellipse shape, wherein a portion of the plate pocket lid is not cut or perforated to act as a living hinge to allow for the plate pocket lid to swing between an open position exposing the inside of the plate pocket to a closed position resting flush with the box lid top surface.

8. The pizza box of claim 7 wherein the plate pocket lid is also formed in a substantially ellipse shape.

9. A method of making a pizza box for storing plates alongside a pizza therein, comprising:

providing a pizza box having a base having a top surface and sidewalls extending perpendicular from edges of said base, and a lid having a top surface and a bottom surface connected to one of said sidewalls, such that the lid may swing from an open position exposing the inside of the box to a closed position resting adjacent to the sidewalls;

attaching a plate pocket to the bottom surface of the box lid the plate pocket comprising a base and sidewalls extending downward from the bottom surface of the box lid a distance less than the total depth of the pizza box, the plate pocket sized to receive at least one plate therein; and cutting a plate pocket lid into the box lid top surface via a cut or perforations cut into the box lid such that the pocket lid is substantially aligned with the plate pocket, and a portion of the pocket lid is left uncut to act as a living hinge to allow for the pocket lid to rotatably open and close about the box top surface between an open position exposing the inside of the plate pocket to a closed position resting flush with the box lid top surface.

10. The method of claim 9 further including the step of cutting a pocket lid tab on an end of the plate pocket lid substantially opposite the pocket lid living hinge.

11. The method of claim 9 wherein the plate pocket lid is cut into a substantially ellipse shape.

12. The method of claim 9 wherein the plate pocket lid is cut into a parallelogram shape.

13. The method of claim 9 wherein the step of cutting the plate pocket lid is further defined by cutting perforations into the box lid in the shape of the plate pocket lid.

14. The method of claim 9 further including the step of disposing a separator within the pizza box to suspend a base of the plate pocket above the top surface of the pizza box base.

15. A method of using a pizza box to store plates and a pizza therein, comprising:

providing a pizza box with a base having sidewalls extending perpendicular from edges of said base, and a lid having a top surface and a bottom surface connected to one of said sidewalls, such that the lid may swing from an open position exposing the inside of the box to a closed position resting adjacent to the sidewalls;

providing a plate pocket connected to the bottom surface of the box lid, said plate pocket comprising a base and sidewalls extending downwards from the box lid a distance less than the total depth of the box, the plate pocket sized to receive at least one plate therein; and providing a plate pocket lid formable from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface;

opening the pizza box lid to expose the plate pocket;

inserting a plate into the plate pocket; and placing a pizza within the pizza box base such that the pizza is surrounded by the base sidewall s.

16. The method of claim 15 further including placing a plurality of plates into the plate pocket.

17. The method of claim 15 further including placing utensils and/or napkins within the plate pocket.

18. The method of claim 15 wherein the step of inserting the plate into the plate pocket is achieved by sliding the plate into a gap disposed between the bottom surface of the pizza box lid and a base of the plate pocket.

19. The method of claim 15 wherein the plate pocket lid is cut into the pizza box lid, and the step of inserting the plate into the plate pocket is achieved by opening the plate pocket lid to expose the plate pocket, and inserting the plate into the exposed plate pocket.

20. The method of claim 15 further including the step of placing a separator on top of the pizza after the pizza is placed within the pizza box, such that the bumper contacts a base of the plate pocket to create a gap between the plate pocket and the pizza to prevent contact between said plate pocket and said pizza.

* * * * *